United States Patent [19]

Carter et al.

[11] Patent Number: 4,704,767

[45] Date of Patent: Nov. 10, 1987

[54] SECURITY DOOR HINGE SYSTEM WITH LOCKING ELEMENTS

[75] Inventors: Robert J. Carter, Elwood; John G. Pecis, Western Springs, both of Ill.

[73] Assignee: Folger Adam Company, Lemont, Ill.

[21] Appl. No.: 817,402

[22] Filed: Jan. 9, 1986

[51] Int. Cl.[4] ..... E05D 5/06

[52] U.S. Cl. ..... 16/388; 16/DIG. 40

[58] Field of Search ..... 16/382, 384, 388, DIG.40

[56] References Cited

U.S. PATENT DOCUMENTS

| | | | |
|---|---|---|---|
| 186,105 | 1/1877 | Bristol | 16/382 |
| 889,798 | 6/1908 | Markey | 16/384 X |
| 1,391,304 | 9/1921 | Dowling | 16/388 |
| 4,085,650 | 4/1978 | Flynn . | |
| 4,133,114 | 1/1979 | Roach | 16/388 X |

FOREIGN PATENT DOCUMENTS

| | | | |
|---|---|---|---|
| 964465 | 8/1950 | France | 16/388 |

*Primary Examiner*—Fred Silverberg

*Attorney, Agent, or Firm*—Willian Brinks Olds Hofer Gilson & Lione Ltd.

[57] ABSTRACT

An improved security door hinging system, wherein the door hinge comprises locking elements in the shape of circular posts on each hinge leaf. Lock engaging means in the form of apertures are located on the door and the door frame to engage the locking elements of the hinge. The locking elements and the lock engaging means cooperate when the door is in the closed position to secure the door to the door frame in the event the conventional mounting screws become inoperable, as when excessive force is applied to the door hinge area.

2 Claims, 4 Drawing Figures

SECURITY DOOR HINGE SYSTEM WITH LOCKING ELEMENTS

BACKGROUND OF THE INVENTION

The present invention relates to an improved system for hinging a door to a door frame, wherein the improved system comprises a plurality of locking elements extending between the mounting side of each hinge leaf and the door and the door frame.

Conventional door hinges are fastened to the door and the door frame generally by means of a plurality of screws or bolts. The size and quality of the screws or bolts determine the ability of the conventional door hinge to withstand forces, in the vicinity of the hinge, directed to removal of the door in the closed position from the door frame. Typically a few heavy blows to the door in the vicinity of the conventional hinge is sufficient to cause the shearing of the fastening screws or bolts and the consequent removal of the door from the door frame.

In security installations such as correctional institutions, mental institutions, hospitals, etc., it is desirable that the door hinge withstand abuse and intentional attempts to damage or remove the door. The conventional door fastening methods teach the use of larger and stronger fastening screws or bolts to enhance the ability of the hinge to withstand such forces. However, due to practical considerations of economy and physical space, the size and quality of these conventional fastening means is limited.

SUMMARY OF THE INVENTION

The present invention is directed to an improved system for hinging a door to a door frame. The improved system enhances the ability of the door hinge to maintain attachment of the door to the door frame under forces directed substantially transverse to the conventional attaching means.

According to this invention, each leaf of a conventional style door hinge, preferably of the type with a hidden hinge pin, comprises at least one locking element. The locking element of one hinge leaf is designed to engage a respective lock engaging means located on the door and the locking element of the other hinge leaf is designed to engage a respective lock engaging means located on the door frame.

In a preferred embodiment of the present invention the locking element comprises a circular post located in the mid-section of each hinge leaf. The locking element protrudes outwardly from the mounting face of each hinge leaf. The lock engaging means comprises apertures, one for each post, each aperture shaped and aligned to receive the locking elements. One aperture is located on the door and one is located on the door frame.

One important advantage of the preferred embodiments described in detail below is that the hinge securing system can withstand substantially greater force directed in the vicinity of the hinge to the removal of the closed door from the door frame than a conventional door hinge. An additional advantage of these embodiments is that it provides a simple, effective and economical means of strengthening door hinging systems. A further advantage of these embodiments is that it complies with the National Association Of Architectural Metal Manufacturers (NAAMM) Standard HMDF-1-85 which requires that a security hinge withstand 50 impact blows of 200 ft. lbs. directed within 6 inches of the hinge.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
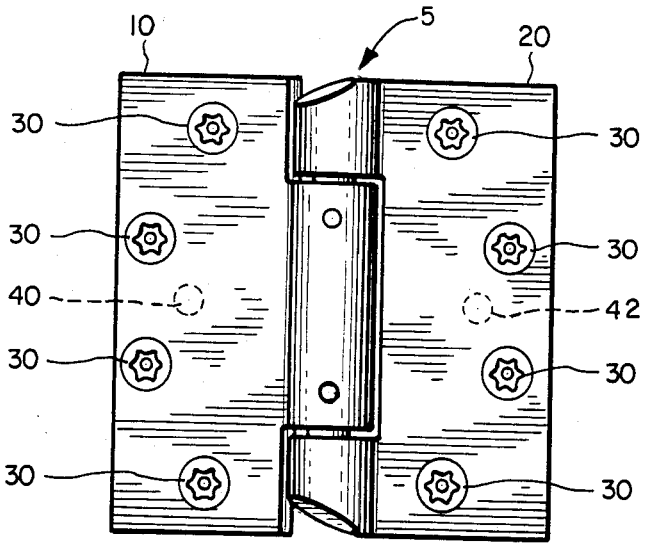
FIG. 1 is a perspective view of the outside face of a preferred embodiment of this invention in the fully spread position.

With reference to the drawings, FIG. 1 shows a presently preferred embodiment of the security door hinge of the present invention. The security hinge 5 shown in FIG. 1 is of the type comprising a hidden hinge pin to prevent the undesired removal of the pin. A detailed description of the hinge pin is not important to an understanding of the present invention and therefore the hinge pin is not shown or discussed in detail. Hidden hinge pins are commonly known and used in the industry. Although the hidden hinge pin is the type of hinge pin preferred in this embodiment, it should be understood that other types of hinge pin mechanisms can be used.

The security hinge 5 comprises a left hinge leaf 10 and a right hinge leaf 20 joined by a hinge pin (not shown). Each hinge leaf 10, 20 comprises four beveled apertures for the insertion of four flat head mounting screws 30. The mounting screws 30 protrude through each hinge leaf 10, 20 and are screwed into a respective mounting surface. The mounting surface for one of the hinge leaves 10, 20 is located on the door and the mounting surface for the other of the hinge leaves 10, 20 is located on the door frame. The beveling of each mounting screw aperture substantially matches the beveling of the flat head screws 30 to ensure that the screws 30 mount substantially flush to the face of each hinge leaf 10, 20 and secure the hinge leaf 10, 20 to the mounting surface.

The locking elements 40, 42 are in the form of circular posts. One post 40, 42 protrudes from the mounting side of each hinge leaf 10, 20. The placement of the posts 40, 42 on each hinge leaf can be seen in FIG. 1 where the posts 40, 42 are depicted as broken lines and in FIG. 2 where the security hinge 5 is shown from a top view with the mounting screws 30 omitted for clarity.

Figure 2:
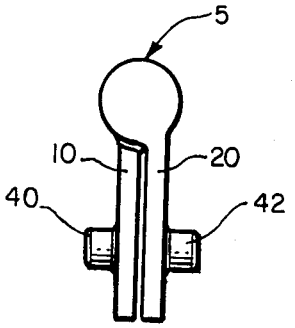
FIG. 2 is a top view of the preferred embodiment of FIG. 1 in the closed position, shown without the mounting screws.
Figure 3:
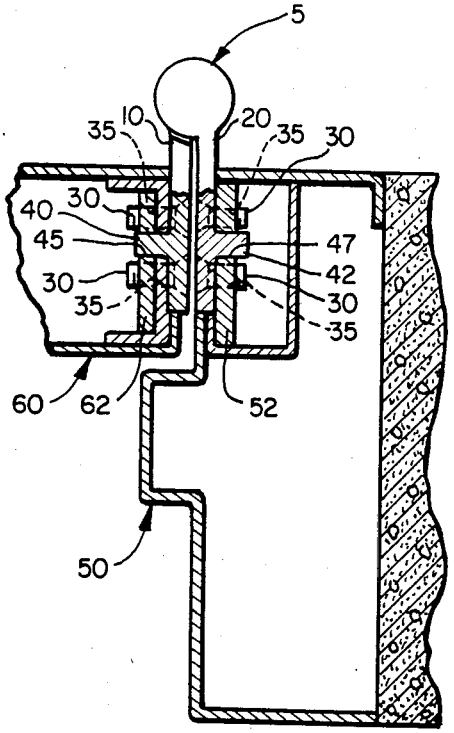
FIG. 3 is a cross-sectional representation of the preferred embodiment of FIG. 1 installed in a door and a door frame.

FIG. 3 shows the preferred embodiment of FIGS. 1 and 2 mounted to a steel door 60 and a steel door frame 50. As is common in security installations, the door 60 and the door frame 50 include steel reinforcement plates 62 and 52, respectively. The installation of the preferred embodiment is conventional with respect to the mounting screws 30. Four threaded apertures 35 are formed in the door 60 and four threaded apertures 35 are formed in the door frame 50. Each aperture 35 is aligned with a respective mounting screw 30. The hinge may be mortised into the door 60 and door frame 50 as determined by the particular installation requirements.

The lock engaging means of this preferred embodiment comprise apertures 45, 47 of sufficient dimensions and alignment to engage the posts 40, 42. One aperture 45, 47 is aligned with each respective post 40, 42. As shown in FIG. 3 aperture 45 extends into the door 60 and through the reinforcement plate 62. Aperture 47 extends into the door frame 50 and through the reinforcement plate 52.

The apertures 45, 47 for the lock engaging means do not require a precise fit with the posts 40, 42. The primary function of the posts 40, 42 and apertures 45, 47 is to maintain the attachment of the closed door to the door frame under forces substantially transverse to the mounting screws 30 in the event the mounting screws 30 are no longer operable to do so. The apertures 45, 47 preferably define a radius up to 1/16 inches greater than the radius of the posts 40, 42. This degree of tolerance is an advantage in that manufacturing and installation costs of the security hinge system of this presently preferred embodiment are reduced.

By way of illustration, and with no limitations intended, the following information is given to define this preferred embodiment in greater detail. In this preferred embodiment, the hinge leaves 10, 20 and posts 40, 42 are investment cast, ASTM 300 series stainless steel, and the hidden hinge pin is formed of ASTM 303 stainless steel. The hidden hinge pin mechanism comprises hardened, AISI D3 tool-steel ball races and ASTM 302 stainless steel ball bearings. Four flat tamper resistant steel TORX® 12–24 machine mounting screws are used to mount each hinge leaf 10, 20. The hinge measures 4½ inches by 4½ inches in the fully spread position. Each hinge leaf 10, 20 is 3/16 inches in thickness. Each post 40, 42 protrudes approximately ⅜ inches from the mounting face of the hinge leaves 40, 42 and is 15/32 inches in diameter. The posts 40, 42 are located ¾ inches from the outside edges of each hinge leaf 10, 20 and 2¼ inches from the upper edge of each hinge leaf 10, 20.

The security hinge 5 was impact tested in accordance with the National Association Of Architectural Metal Manufacturers Standard HMDF-1-85. The security hinge 5 was subjected to 50 impact blows of 200 ft. lbs. directed within 6 inches of the improved hinge system 5 with the door 60 in the closed position. The 1/16 inch radial clearance between the post 40, 42 and the aperture 45, 47 permitted the mounting screws 30 to be sheared after approximately 6 blows. However, the posts 40, 42 and apertures 45, 47 held the security hinge 5 secure to the door 60 and door frame 50 for the remaining 44 blows to easily pass the NAAMM standard.

Figure 4:
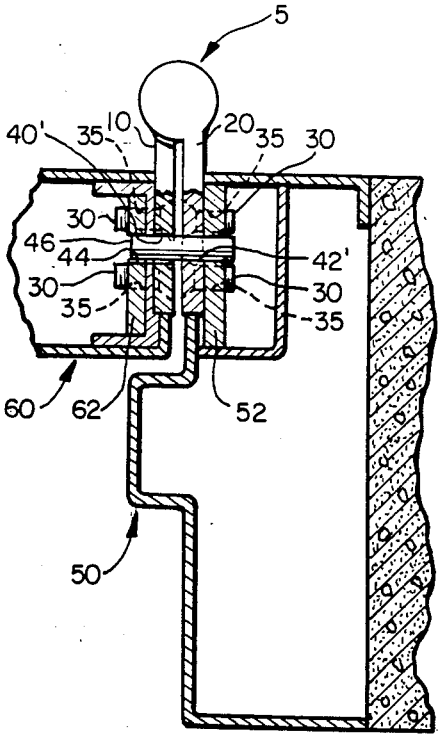
FIG. 4 is a cross-sectional representation of a second preferred embodiment of this invention installed in a door and a door frame.

A second preferred embodiment of this invention is shown in FIG. 4. In this embodiment, a lock engaging means is located on each leaf 10, 20 of the security hinge 5 in the form of apertures 40', 42'. A lock engaging means in the form of an aperture 44 is also located in the door 60 and through the reinforcement plate 62. A locking element, in the form of a post 46 of circular cross-section, extends from the door frame reinforcement plate 52 and the door frame 50. The mounting of the security hinge 5 with the mounting screws 30 is similar to the mounting of the first preferred embodiment and therefore will not be discussed in detail.

The apertures 40', 42', 44 and the post 46 are aligned and shaped such that when the door 60 is in the substantially closed position the post 46 engages each of the apertures 40', 42', 44. The apertures 40', 42', 44 and the post 46 are further shaped and aligned such that substantial impairment of the pivotal operation of the door 60 about the security hinge 5 does not occur. As with the first preferred embodiment, the second preferred embodiment enhances the ability of the security hinge 5 to secure the door 60 to the door frame 50 in the substantially closed position against destructive forces.

It should be understood that materials or components different from those used in the preferred embodiments may be selected to reduce the cost or to increase the holding characteristics of the security hinge system. For example, in the first preferred embodiment, the posts 40, 42 may be attached to the hinge leaves 10, 20 by means other than casting. Similarly, the posts 40, 42 may be of a form other than a circular post, such as a square or elliptical cross-section. Furthermore, the locking elements 40, 42 may be apertures and the corresponding lock engaging means 45, 47 located on the door 60 and the door frame 50 may be in the form of circular posts. It should also be understood that the posts may comprise hollow cylinders or may be solid. Further, the post receptacles may comprise hollow cylinders for concentric engagement with the posts.

Similarly, in the second preferred embodiment the post 46 may extend from the door reinforcement plate 62 rather than from the door frame reinforcement plate 52. Also, one of the hinge leaves such as leaf 20 may be attached to the door frame by welding means and the post 46 extended from the outer face of the leaf 20.

The foregoing detailed description has been given for illustration purposes only. A wide range of changes and modifications can be made to the preferred embodiment described above. It should therefore be understood that it is the following claims, including all equivalents, which are intended to define the scope of this invention.

We claim:

1. In a door hinging system of the type comprising a door, a door frame, a hinge mechanism comprised of at least a first element operative for attachment to the door and at least a second element operative for attachment to the door frame, the door and door frame each comprising a mounting face and means for attaching the first element to the door mounting face and the second element to the door frame mounting face, the improvement comprising:

at least one first locking element located on the first element to be noncoaxial with the means for attaching the first element to the door;

at least one first lock engaging means located on the door, the at least one first lock engaging means shaped and aligned for engagement with the first locking element;

at least one second locking element located on the second element to be noncoaxial with the means for attaching the second element to the door frame and at least one second lock engaging means located on the door frame, the at least one second lock engaging means shaped and aligned for engagement with the second locking element;

the first and second locking elements and the first and second lock engaging means operative to substantially secure the door to the door frame under forces directed substantially parallel to the door mounting face and the door frame mounting face, the first and second locking elements and the first and second lock engaging means further operative to not substantially secure the door to the door frame under forces directed substantially transverse to either the door mounting face or the door frame mounting face the first and second locking elements and one of the first and second lock engaging means comprise apertures and the other one of the first and second lock engaging means comprise a post, wherein the first and locking elements and the one of the first and second lock engaging means are shaped and aligned to engage the other one of the first and second lock engaging means, wherein one of the door and the door frame comprises a separate reinforcing plate, said post being connected to said reinforcing plate.

2. In a door hinging system of the type comprising a door, a door frame, a hinge mechanism comprised of a first element for attachment to the door and a second element for attachment to the door frame, and means for attaching the first and second elements to the door and the door frame respectively, the hinging mechanism operative to permit the door to swing between an opened and a closed position while pivotally attaching the door to the door frame, the improvement comprising:

at least one first lock engaging means located on said first element;

at least one second lock engaging means located on said second element and aligned with the first lock engaging means; and at least one third lock engaging means located on one of the door and door frame and aligned with the first and the second lock engaging means;

at least one locking element located on the other one of the door and door frame, the at least one locking element aligned and shaped to engage the first lock engaging means and the second lock engaging means and the third lock engaging means when the door is in the substantially closed position;

the locking element and the first, second and third lock engaging means operative to not substantially impair the pivotal movement of the door and operative to substantially secure the door to the door frame while the door is in the substantially closed position; the first, second and third lock engaging means comprise apertures; the locking element comprises a post; wherein one of the door and the door frame comprises a separate reinforcing plate, said post being connected to said reinforcing plate.

* * * * *

UNITED STATES PATENT AND TRADEMARK OFFICE

CERTIFICATE OF CORRECTION

PATENT NO. : 4,704,767

DATED : Nov. 10, 1987

INVENTOR(S) : Robert J. Carter et al.

It is certified that error appears in the above-identified patent and that said Letters Patent is hereby corrected as shown below:

IN THE CLAIMS

In Claim 1 (column 5, line 5), please insert a semi-colon (;) after the word "face";

In Claim 1 (column 5, line 9), after the words "the first and" please insert the word --second--.

Signed and Sealed this

Fifteenth Day of November, 1988

*Attest:*

*Attesting Officer*

DONALD J. QUIGG

*Commissioner of Patents and Trademarks*